United States Patent [19]

Tsunoi et al.

[11] Patent Number: 4,905,046

[45] Date of Patent: Feb. 27, 1990

[54] COPYING APPARATUS HAVING MEANS FOR MOVING THE OPTICAL SCANNING SYSTEM TO A PREDETERMINED POSITION WHEN AN ABNORMALITY IS DETECTED

[75] Inventors: Haruo Tsunoi; Naoki Okuda, both of Kanagawa; Akiyoshi Kimura, Tokyo, all of Japan

[73] Assignee: Canon Kabushiki Kaisha, Tokyo, Japan

[21] Appl. No.: 197,165

[22] Filed: May 23, 1988

[30] Foreign Application Priority Data

May 26, 1987 [JP] Japan ..... 62-127185

[51] Int. Cl.[4] ..... G03G 15/00

[52] U.S. Cl. ..... 355/235; 355/308; 355/210

[58] Field of Search ..... 355/14 R, 14 SH, 8, 355/3 SH, 3 R

[56] References Cited

U.S. PATENT DOCUMENTS

| | | | |
|---|---|---|---|
| 4,465,359 | 8/1984 | Nakahata | 355/8 X |
| 4,521,099 | 6/1985 | Katayama et al. | 355/8 |
| 4,575,223 | 3/1986 | Shimono et al. | 355/8 |
| 4,596,456 | 6/1986 | Ide | 355/8 X |

*Primary Examiner*—R. L. Moses

*Attorney, Agent, or Firm*—Fitzpatrick, Cella, Harper & Scinto

[57] ABSTRACT

A copying apparatus having an optical scanning system includes an upper casing that can be opened and closed and a scanning device on the upper casing for scanning an original. The scanning device includes an abnormality detector for detecting the occurrence of an abnormality during a copy operation. When an abnormality is detected by the detector, the scanning device is moved to a scanning start position.

18 Claims, 6 Drawing Sheets

COPYING APPARATUS HAVING MEANS FOR MOVING THE OPTICAL SCANNING SYSTEM TO A PREDETERMINED POSITION WHEN AN ABNORMALITY IS DETECTED

BACKGROUND OF THE INVENTION

1. Field of the Invention

This invention relates to an image forming apparatus comprising an upper casing which is swingable on a fulcrum shaft and is mounted on a lower casing which is provided with a copy material transport means and movable scanning means disposed within the upper casing.

2. Description of the Related Art

The image forming apparatuses of the above stated kind include an apparatus which is arranged as shown in FIG. 1 of the accompanying drawings. This is a copier having a copy-board 101 secured to the upper casing 106. With an original 103 placed on the copy-board 101, an image corresponding to the image of the original 103 is formed on a recording material (or copy paper) 104 in accordance with a known electro-photographic method by moving a scanning optical system 102 along rails in the direction of arrow A or B to have the original 103 exposed to light from the optical system 102. The apparatus main body consists of the upper casing 106 and a lower casing 107. To facilitate replacement work on a photosensitive member drum 105, maintenance or inspection work and work to take out the recording material 104 in the event of the occurrence of a jam, which is a typical problem when transporting the recording material 104, the upper casing 106 is arranged to be swingable to open and close on a fulcrum shaft 108 relative to the lower casing 107. The arrangement is such that, when the upper casing 106 is opened, the scanning optical system 102, which is arranged within the upper casing 106 is lifted up to expose to the outside the recording material transport passage, etc. which is disposed within the lower casing 107.

The conventional apparatus mentioned above has been arranged such that, in the event of the occurrence of a jam during a transport action on the recording material or copy paper 104, the transporting process, the movement of the scanning optical system 102 and the action of the photosensitive member drum 105 are brought to a stop and a jam display is made by means of a lamp or the like. Therefore, when the upper casing 106 is opened for removal of the recording material 104 after a jam occurred during the process of scanning by the scanning optical system 102 and with the original thus stopped from being scanned, the scanning optical system 102 slides down by its own weight in the direction of arrow A along the rails and comes to a stop colliding with a rail end member. This has presented a problem since a mirror of the scanning optical system tends to be dislodged from its set angular position by the impact and a lamp or a reflector of the optical system tends to be also dislodged and damaged.

To solve this problem, therefore, a method for preventing the scanning optical system 102 from sliding down by locking it with a lock member when the upper casing 106 is opened has been proposed, for example, in Japanese Patent Publication No. SHO 59-3735. It is another conceivable solution of this problem to make the scanning optical system 102 less slidable over the rails. However, the former solution necessitates the lock member to be arranged to operate in association with the opening movement of the upper casing 106 which requires a complex arrangement and thus incurs an increase in cost. As to the latter solution of making the rails less slidable, it requires a greater driving force on the scanning optical system for the process of effecting an exposure which not only causes an increase in electrical energy consumption but also deteriorates the quality of images formed because of unsmooth scanning.

Meanwhile, Japanese Laid-Open Patent Application No. SHO 55-153949 and U.S. Pat. No. 4,432,639 have disclosed a copier which is provided with lock means. The lock means is arranged to allow the upper casing to be lifted up only after the copy-board is manually moved to a part of the upper casing which is located on the lower side of the upper casing when the upper casing is rotated upward. However, that arrangement is inconvenient for an operator who is either unaware of or has forgotten that the upper casing cannot be lifted up unless the copy-board is moved in one direction beforehand. The operator then tends to try to lift the upper casing by force when he or she sees the light of a jam display which might break the apparatus.

U.S. Pat. No. 4,312,587 discloses a copier which is arranged to have the scanning optical system move to a given position in the event of a jammed state. However, that disclosure fails to include any arrangement necessary for opening and closing the upper casing by rotating the upper casing relative to the lower casing.

SUMMARY OF THE INVENTION

It is a general object of this invention to solve the above stated problems of the prior art.

It is a more specific object of the invention to provide an image forming apparatus which is arranged to prevent the scanning optical system thereof from sliding down when the upper casing opens without necessitating any complex device and without incurring any increase in electric energy consumption and deterioration in the quality of images.

Other objects and features of the invention will become apparent from the following detailed description.

DETAILED DESCRIPTION OF THE PREFERRED EMBODIMENTS

Figure 1:
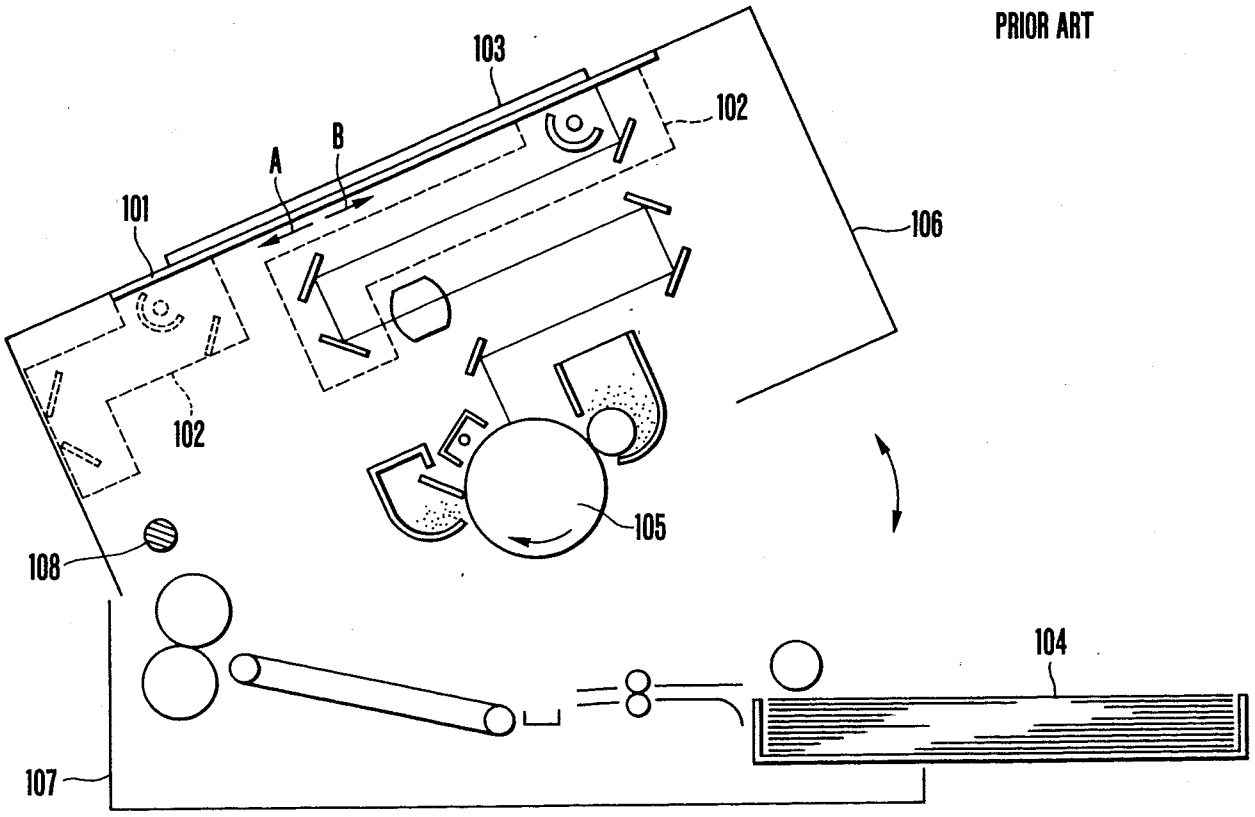
FIG. 1 PRIOR ART
FIG. 1 is a schematic illustration showing in outline form the arrangement of the conventional image forming apparatus in a state having the upper casing thereof opened.
Figure 2:
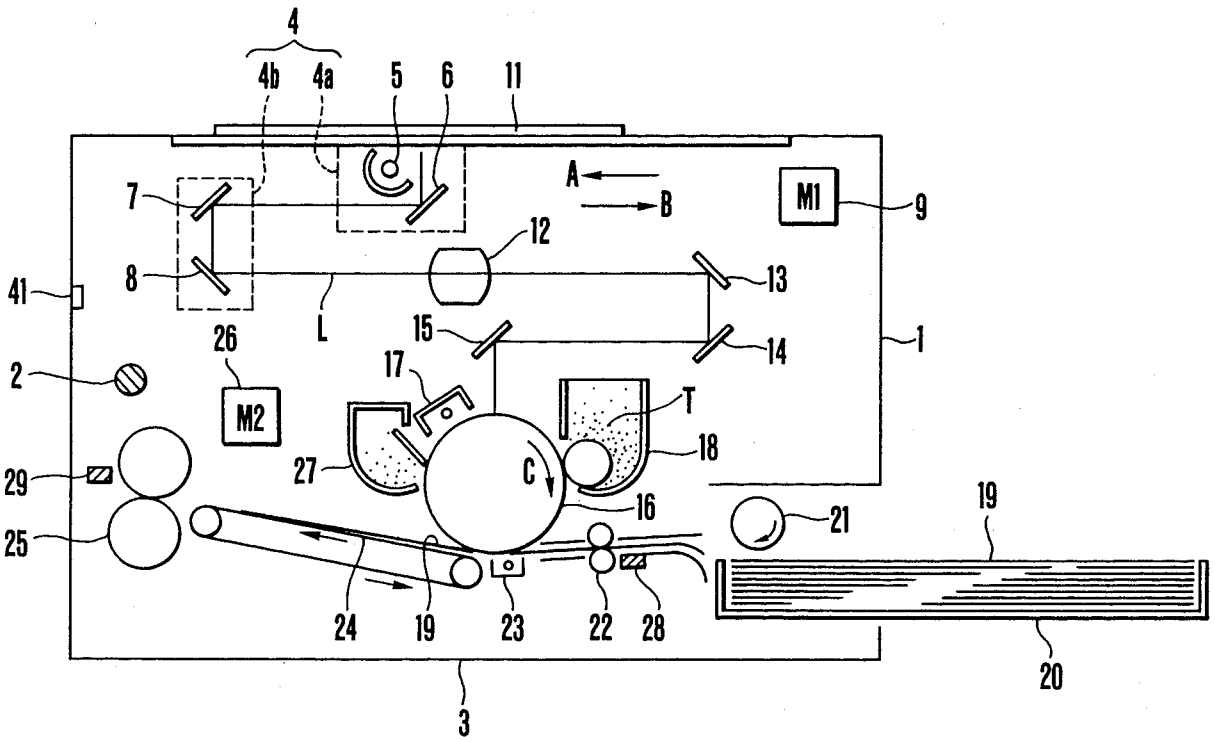
FIG. 2 is a schematic illustration showing in outline form an image forming apparatus arranged according to this invention as an embodiment thereof.
Figure 3:
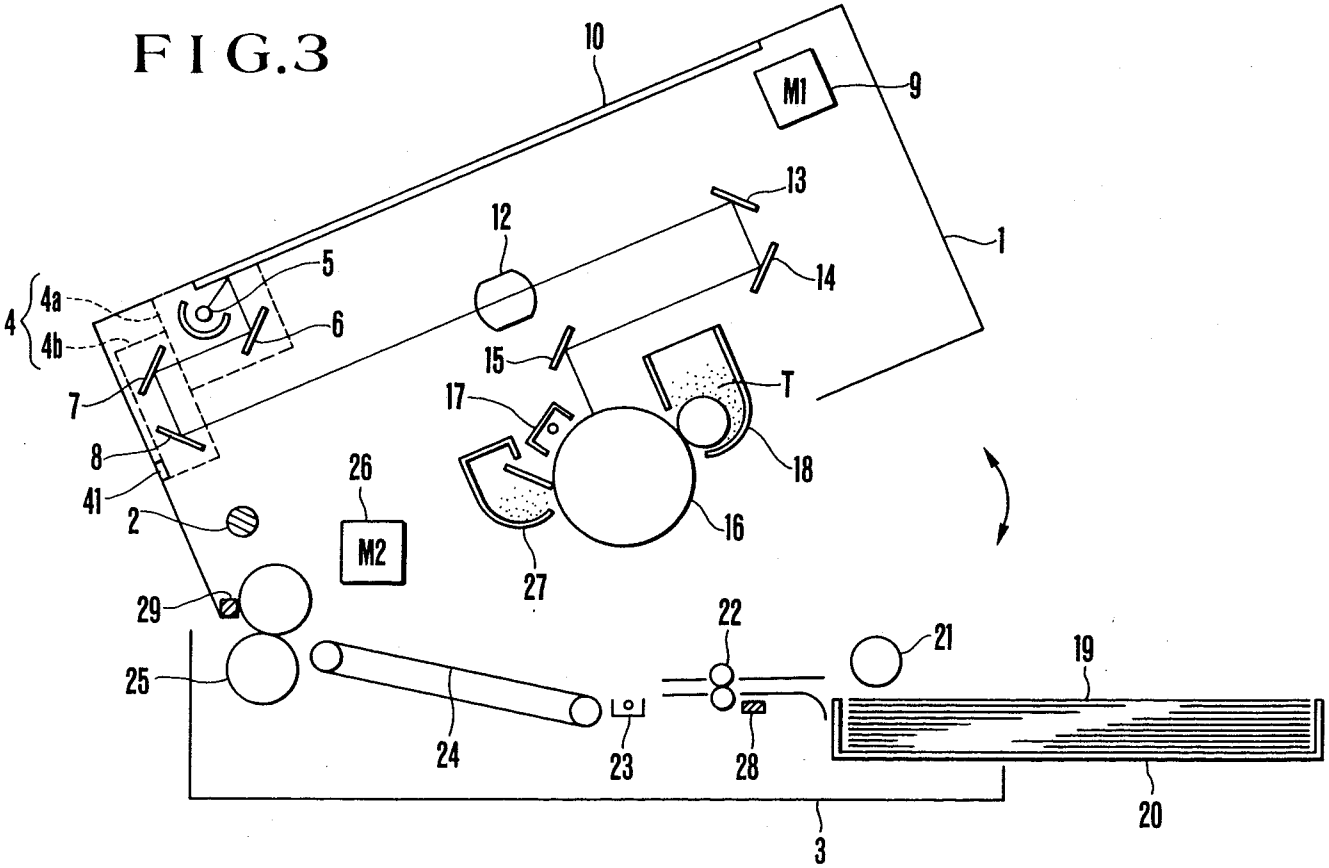
FIG. 3 is a schematic illustration showing the same embodiment in a state having the upper casing thereof opened.

FIGS. 2 and 3 show in outline form the arrangement of an image forming apparatus which is arranged according to this invention as an embodiment thereof. While FIG. 2 shows the apparatus in a normal operating state, FIG. 3 shows it in a state having an upper casing 1 opened relative to a lower casing 3 by rotating the upper casing 1 on a fulcrum shaft 2. Referring to these drawings, a scanning optical system 4 is disposed within the upper casing 1. The scanning optical system 4 comprises a first optical unit 4*a* which includes a light source lamp 5 and a reflecting mirror 6, and a second optical unit 4*b* which includes reflecting mirrors 7 and 8. The reflecting mirrors 7 and 8 are opposed to each other at an angle of 90 degrees. The first and second optical units 4*a* and 4*b* are arranged to be driven by the driving force of an optical system driving, reversely rotatable motor 9 at different speeds which are in the ratio of 2:1. With the scanning optical system 4 thus moved in the direction of arrow B, an original 11 placed on a copy glass board 10 secured to the upper casing 1 is exposed to light and scanned by the optical system 4.

The optical units 4*a* and 4*b* can be moved back and forth by one of various known devices. For example, a device disclosed by U.S. Pat. No. 4,158,499 may be used for reciprocating the optical units 4*a* and 4*b* by rotating forward and backward the driving pulley of the device by means of a motor 9.

With the original 11 thus exposed to light, an image light L is obtained. The image light L is deflected by the reflecting mirrors 6, 7 and 8. The light L then comes via an image forming lens 12 to a reflecting mirror 13 to be again deflected by reflecting mirrors 14 and 15. The deflected light L is guided to the surface of an electrophotographic photosensitive member drum 16. The drum 16 has its surface uniformly charged beforehand by means of a primary charger 17. An electrostatic latent image is formed with the deflected light L projected on the charged surface of the drum 16. Then, the rotation of the photosensitive member drum 16 in the direction of arrow C causes the electrostatic latent image to be opposed to a developing device 18. The developing device 18 then converts the latent image into a visible toner image.

Recording papers (or copy material) 19 which are placed on a cassette 20 are brought into a position in front of registration rollers 22 by a paper feed roller 21 one by one. The registration rollers 22 are arranged to feed the recording paper 19 in synchronism with the movement of the visible toner image obtained on the photosensitive member drum 16. Then, a transfer charger 23 transfers the toner image formed on the drum 16 to the recording paper 19 by the action of an electric field. The recording paper 19 is then conveyed by a conveyor belt 24 to a fixing device 25 to have the toner image fixed thereby.

A main motor 26 is arranged to drive the photosensitive member drum 16, a recording paper transport means consisting of the rollers 21 and 22 and the conveyor belt 24, the fixing device 25. A cleaner 27 is arranged to remove paper dust and the residual toner remaining on the drum 16 and not transferred. The recording paper transport means is disposed within the lower casing 3.

The embodiment is further provided with sensors 28 and 29 for detecting the occurrence of any abnormality in conveying the recording paper 19. They are optical sensors arranged to detect the presence or absence of the recording paper 19 in front of them.

Figure 4:
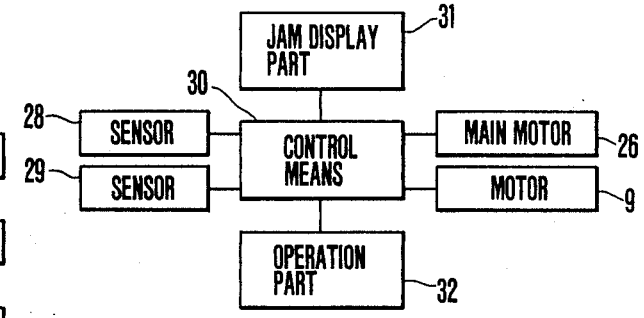
FIG. 4 is a block diagram showing control means of the same embodiment of the invention.

FIG. 4 is a block diagram showing the control system of this embodiment. Referring to FIG. 4, the control system comprises the above stated sensors 28 and 29; control means 30 which includes a timer and a microcomputer; a jam display part 31 which is composed of a lamp or an LED or the like; and an operation part 32 which includes a copy button. The control means 30 is arranged to detect occurrence of an abnormality in the recording paper transport operation on the basis of a detection signal from the sensor 28 or 29. More specifically, a jam is regarded as having occurred in front of the sensor 28 when the paper remains undetected by the sensor 28 after the lapse of a given length of time from commencement of the operation of the paper feed roller 21; or at the sensor mounting position when the length of time at which the recording paper 19 passes the sensor 28 or 29 is longer than a given length of time.

Figure 5:
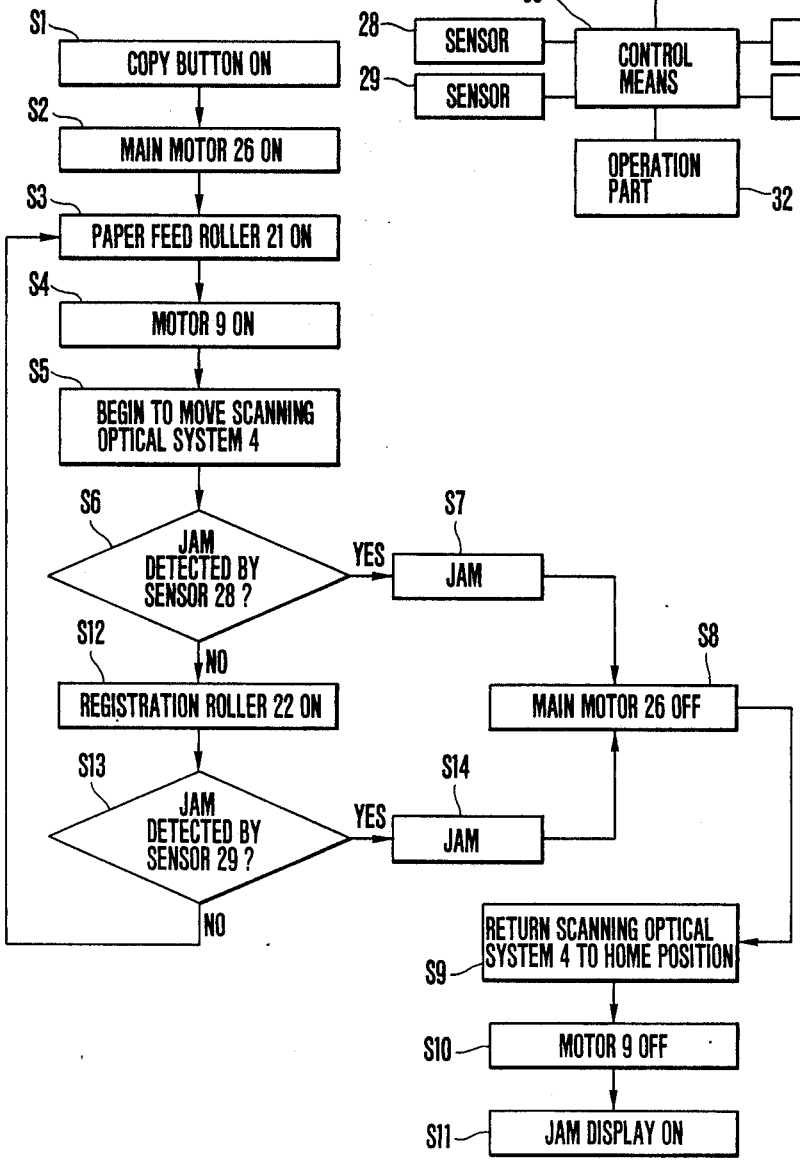
FIG. 5 is a flow chart showing the operation of the same embodiment.

Referring to FIG. 5, the embodiment which is arranged as described above operates as follows: First, when an operator pushes the copy button of the operation part 32 at a step S1, the main motor 26 turns on at a step S2. At a step S3: The drum 16 and the paper feed roller 21 begin to rotate. At a step S4: The motor 9 is switched on. At a step S5: The scanning optical system 4 begins to move from its home position. At a step S6: The sensor 28 which serves also as a registration sensor makes a check to see if the recording paper 19 is jammed. At a step S7: The sensor 28 detects that a jammed state has occurred. In that event, the flow of operation comes to a step S8. At step S8: The main motor 26 is switched off to bring the drum 16 and the transport means to a stop. At a step S9: The motor 9 is rotated in the reverse direction to bring the scanning optical system 4 back to its home position. At a step S10: The motor 9 is switched off. At a step S11: The jam display is made. The jam display informs the operator of the occurrence of a jammed state. The operator then lifts the upper casing 1 up and away from the lower casing 3 to remove the jammed paper from the paper transport path.

Meanwhile, if the recording paper 19 is found not to be in a jammed state at step S6, the flow of operation comes to a step S12. At step S12: The registration roller 22 is switched on. At a step S13: An image is formed on the surface of the recording paper 19. After that the sensor 29 which is arranged to serve also as a delivery sensor makes a check for a jam. At a step S14: The sensor 29 finds the copy paper to be in a jammed state. Then, the flow of operation comes to the step S8. At step S8: The main motor 26 is switched off to bring the drum 16 and the transport means to a stop. Then the flow comes to step S9 to bring the scanning optical system 4 back to its home position by reversely rotating the motor 9. The motor 9 is switched off at step S10 and a jam display is made at step S11.

If no jammed state of the paper is detected by the sensor 29 at the step S13, flow of operation comes back to step S3 for forming a next image.

As described above, in the event of the occurrence of a jam, the scanning optical system 4 is moved back without fail to its home position, which is located at one end of its path of movement on the side of the fulcrum shaft 2 on which the upper casing 1 rotates. This arrangement effectively prevents the scanning optical system 4 from sliding down by its own weight to disturb the mirrors from their mounted angular positions or to dislodge the lamp or the like by bumping against some other member, such as a home position stopper 41.

In the case of this embodiment the optical system 4 is arranged to be brought back, when a jam occurs, to one end position (home position) in the path of its reciprocal motion from which it begins to move in scanning the original. However, this arrangement may be changed to have the optical system 4 returned to a position which is a little nearer than the home position by means of the motor 9. In the case of such a modification, the optical system 4 may be allowed to move back to its home position by its own weight when the upper casing 1 is lifted up. However, such movement is limited to a distance short enough to present the above stated inconvenience.

The jam display part 31 is arranged to light up a little while after the optical system 4 comes to its home position or comes near thereto, so that the above stated inconvenience, never occurs even if the upper casing 1 is lifted up immediately after the display.

Figure 6:
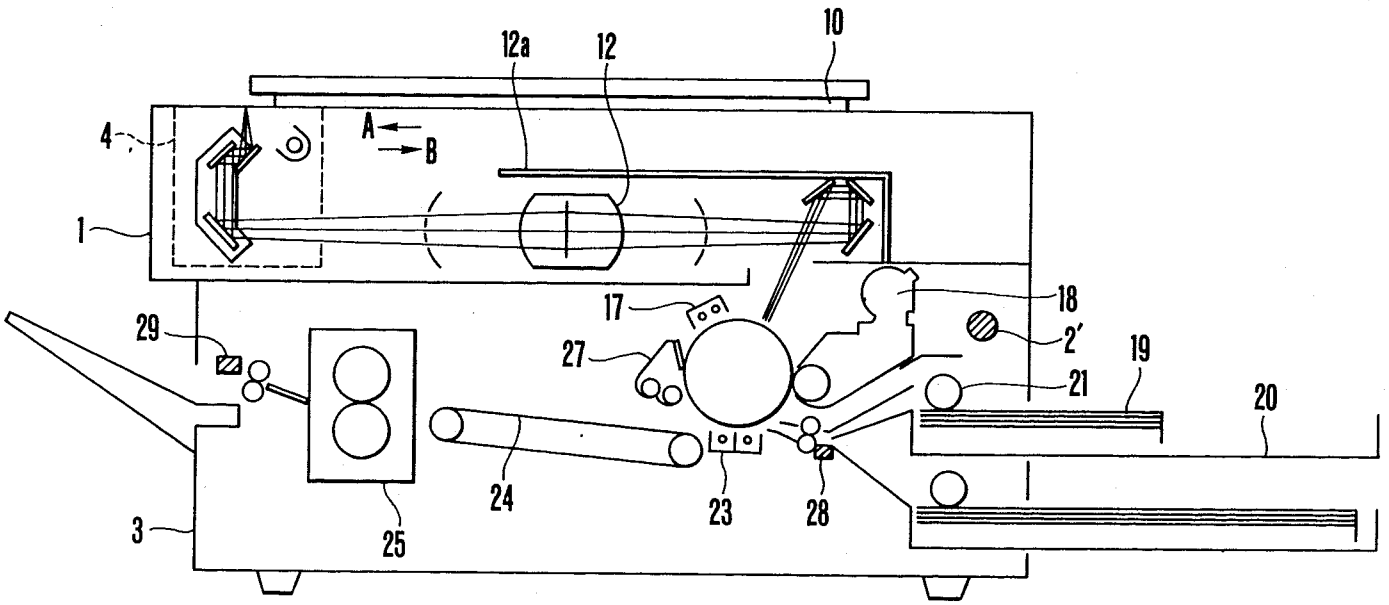
FIG. 6 is a schematic illustration showing in outline form the arrangement of an image forming apparatus which is arranged according to this invention as another embodiment thereof.
Figure 7A:
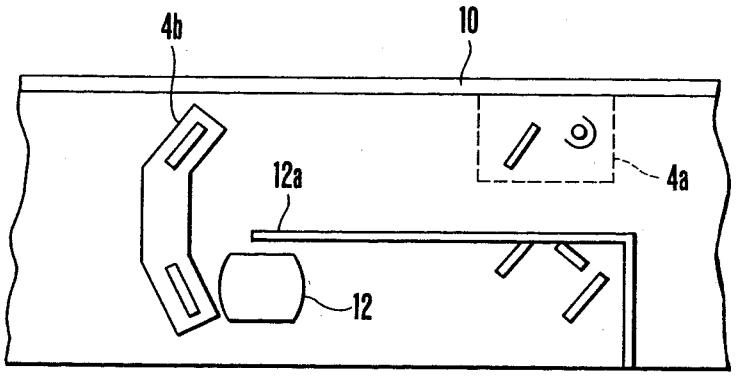
FIGS. 7(a) and 7(b) schematically show the different movement positions of the scanning optical system of the same embodiment.
Figure 7B:
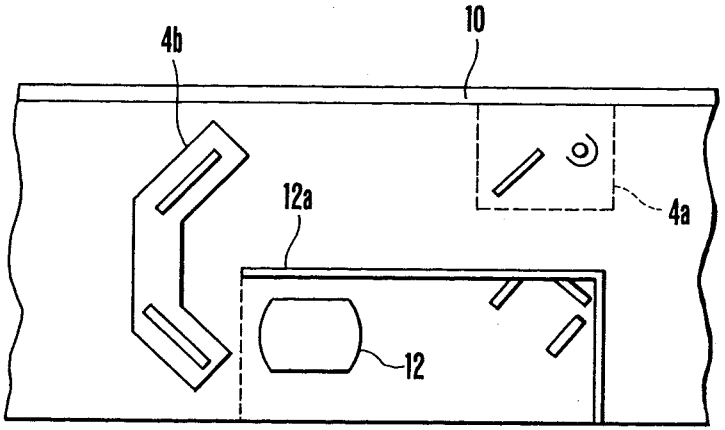

FIG. 6 shows in outline form an image forming apparatus arranged as a second embodiment of the invention. The same components and parts as those of the first embodiment shown in FIG. 2 are indicated by the same reference numerals. In the case of the second embodiment, a fulcrum shaft 2' which is to be used for opening the upper casing 1 is disposed on the right-hand side as viewed on the drawing instead of the left side. The arrangement is such that, when the upper casing 1 is opened, the home position is located at a higher part. Further, in this case, the copying magnification is arranged to be variable by shifting the image forming lens 12 in the direction of arrow A or B. The image forming lens 12 is covered with a lens hood **12*a*. In the event of detection of a jam, the scanning optical system 4 is not returned to its home position but is arranged to be moved to a position near the lens hood 12*a* of the image forming lens 12 as shown in FIG. 7(b). Further, in the case where the image forming lens 12 comes to the outside of the lens hood 12*a* as shown in FIG. 7(a) with the copying magnification changed from one value over to another, the control means 30 controls and causes the second optical unit 4*b* of the scanning optical system 4 to come to a stop in a given position which is in the neighborhood of the image forming lens 12 corresponding to the copying magnification selected. This control prevents the scanning optical system 4 from accelerated sliding down. Therefore, no damage will be caused by the optical system 4 when the upper casing 1 opens. With the exception of the above stated points, the second embodiment is arranged in the same manner as the first embodiment shown in FIG. 2**. Therefore, the rest of the arrangement of the second embodiment are omitted from description.

Further, each of the embodiments described is arranged to have two sensors. However, the invention is not limited to the use of two sensors. In accordance with the invention, the number of sensors may be one or three or more than three. Further, the sensors do not have to be optical sensors. They may be replaced with some mechanical sensors or sensors of some other kind.

While the embodiment described is provided with two motors as drive sources including the main motor and the motor for driving the optical system. However, the invention is not limited to that arrangement. The drive source arrangement may be changed to control the operation of the apparatus by using a single motor in combination with a clutch for changing one driving force over to another.

What is claimed is:

1. A copying apparatus having an optical scanning system comprising:

a lower casing;

an upper casing arranged to open and close relative to said lower casing;

scanning means, arranged on said upper casing, for scanning an original; and an abnormality detector for detecting an abnormality the copying operation, wherein said scanning means is moved to a predetermined scanning start position of said upper casing when said abnormality detector detects an abnormality, said scanning start position being at a side opposed to an opening side of said upper casing.

2. A copying apparatus according to claim 1, wherein said scanning means reciprocates along a movement path that inclines when said said upper casing is opened.

3. A copying apparatus according to claim 1, wherein said upper casing opens and closes around a rotation shaft provided at an edge of said upper casing relative to said lower casing.

4. A copying apparatus according to claim 1, wherein said abnormality detector detects trouble in the transportation of a copy material.

5. A copying apparatus according to claim 1, wherein said lower casing has means for transporting a copy material and said lower casing is exposed when said upper casing is opened.

6. A copying apparatus according to claim 1, wherein said abnormality detector detects maintenance and inspection times for the apparatus.

7. A copying apparatus according to claim 6, wherein said abnormality detector detects the time for an exchange of a photosensitive member on which an image of the original is formed.

8. A copying apparatus according to claim 6, wherein said abnormality detector detects the time for performing internal cleaning of the apparatus.

9. A copying apparatus having an optical scanning system, comprising:

a lower casing;

an upper casing arranged to open and close relative to said lower casing;

first and second scanning means for scanning an original, both scanning means being provided on said upper casing;

a common driving system for moving said first and second scanning means at a predetermined speed ratio;

a positioning member for positioning said second scanning means; and an abnormality detector means for detecting an abnormality in the copy operation, wherein said second scanning means is moved to a predetermined retreated position by said positioning member when said abnormality detector detects an abnormality.

10. A copying apparatus according to claim 9, wherein said common driving system includes a driving pulley which reciprocatingly moves said first and second scanning means by its forward and reverse rotations.

11. A copying apparatus according to claim 9, wherein said first and second scanning means reciprocates along a movement path that inclines when said upper casing is opened.

12. A copying apparatus according to claim 9, wherein said upper casing opens and closes around a rotation shaft provided at an edge of said upper casing relative to said lower casing.

13. A copying apparatus according to claim 12, wherein said positioning member is provided at the same side of said upper casing as said the rotation shaft.

14. A copying apparatus according to claim 9, wherein said abnormality detector detects trouble in the transportation of a copy material.

15. A copying apparatus according to claim 9, wherein said lower casig has means for transporting a copy material and said lower casing is exposed when said upper casing is opened.

16. A copying apparatus according to claim 9, wherein said abnormality detector detects a time point for maintenance and inspection of the apparatus.

17. A copying apparatus according to claim 16, wherein said maintenance and inspection include exchanges of a photosensitive member drum.

18. A copying apparatus according to claim 16, wherein said maintenance and inspection include internal cleaning of the apparatus.

* * * * *

UNITED STATES PATENT AND TRADEMARK OFFICE

CERTIFICATE OF CORRECTION

PATENT NO. : 4,905,046

DATED : February 27, 1990

INVENTOR(S) : HARUO TSUNOI ET AL.

It is certified that error appears in the above-identified patent and that said Letters Patent is hereby corrected as shown below:

COLUMN 1

Line 27, "ratus" should read --ratus'--.
Line 39, "etc." should be deleted.

COLUMN 3

Line 61, "rollers 21 and 22 and" should read --rollers 21 and 22,--.
Line 62, "belt 24," should read --belt 24 and--.

COLUMN 5

Line 15, "present" should read --prevent--.
Line 20, "inconvenience," should read --inconvenience--.
Line 54, "are" should read --is--.
Line 65, "system. However," should read --system, however,--.

COLUMN 6

Line 12, "the" should read --in the--.

UNITED STATES PATENT AND TRADEMARK OFFICE

CERTIFICATE OF CORRECTION

PATENT NO. : 4,905,046

DATED : February 27, 1990

INVENTOR(S) : HARUO TSUNOI ET AL.

It is certified that error appears in the above-identified patent and that said Letters Patent is hereby corrected as shown below:

COLUMN 8

Line 2, "lower casig" should read --lower casing--.
Line 10, "changes" should read --change--.

Signed and Sealed this

Twentieth Day of August, 1991

*Attest:*

*Attesting Officer*

HARRY F. MANBECK, JR.

*Commissioner of Patents and Trademarks*